US010531203B2

(12) United States Patent
Voutilainen et al.

(10) Patent No.: US 10,531,203 B2
(45) Date of Patent: Jan. 7, 2020

(54) ACOUSTIC APPARATUS AND ASSOCIATED METHODS

(71) Applicant: Nokia Technologies Oy, Espoo (FI)

(72) Inventors: Martti Voutilainen, Espoo (FI); Oleksandr Kononenko, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 70 days.

(21) Appl. No.: 15/771,229

(22) PCT Filed: Oct. 7, 2016

(86) PCT No.: PCT/FI2016/050702
§ 371 (c)(1),
(2) Date: Apr. 27, 2018

(87) PCT Pub. No.: WO2017/077176
PCT Pub. Date: May 11, 2017

(65) Prior Publication Data

US 2019/0058955 A1 Feb. 21, 2019

(30) Foreign Application Priority Data

Nov. 5, 2015 (EP) ..... 15193289

(51) Int. Cl.
*H04R 17/00* (2006.01)
*H04R 7/06* (2006.01)

(52) U.S. Cl.
CPC ..... *H04R 17/00* (2013.01); *H04R 7/06* (2013.01); *H04R 2307/023* (2013.01); *H04R 2400/01* (2013.01)

(58) Field of Classification Search
CPC ..... H04R 17/00; H04R 17/02; H04R 17/025; H04R 17/005; H04R 17/10; H04R 31/00;
(Continued)

(56) References Cited

U.S. PATENT DOCUMENTS 9,264,796 B2 * 2/2016 Pinkerton ..... H04R 1/283
2014/0270271 A1 * 9/2014 Dehe ..... B81B 3/0018 381/174
2016/0284978 A1 * 9/2016 Aliane ..... H01L 41/45

FOREIGN PATENT DOCUMENTS

CN 204104134 U 1/2015
WO 2013/049794 A1 4/2013
WO 2014/100012 A1 6/2014

OTHER PUBLICATIONS

"A Graphene Microphone and Loudspeaker That Operate at up to 500 Kilohertz", Kurzweil Accelerating Intelligence, Retrieved on Apr. 23, 2018, Webpage available at : http://www.kurzweilai.net/a-graphene-microphone-and-loudspeaker-that-operate-at-up-to-500-kilohertz.

(Continued)

*Primary Examiner* — Matthew A Eason
(74) *Attorney, Agent, or Firm* — Nokia Technologies Oy

(57) ABSTRACT

An apparatus comprising a piezoelectric diaphragm positioned between opposing first and second electrodes, the piezoelectric diaphragm comprising a stack of graphene oxide layers between respective electrode-engaging layers of reduced graphene oxide, wherein the apparatus is configured to have one or more of a sound output mode and a sound input mode such that: in the sound output mode, the first and second electrodes are configured to apply a voltage to the reduced graphene oxide layers to generate an electric field across the graphene oxide stack, the generated electric field causing vibration of the piezoelectric diaphragm to produce a sound output wave corresponding to the applied voltage, and in the sound input mode, the reduced graphene oxide layers are configured to collect electrical charge which is induced in the graphene oxide layers by vibration of the piezoelectric diaphragm in response to a sound input wave, the collected electrical charge creating a voltage between the (Continued)

first and second electrodes corresponding to the sound input wave.

19 Claims, 4 Drawing Sheets

(58) Field of Classification Search
CPC ..... H04R 7/06; H04R 19/00; H04R 19/02; H04R 19/04
See application file for complete search history.

(56) References Cited

OTHER PUBLICATIONS

Tian et al., "Flexible and Large-Area Sound-Emitting Device Using Reduced Graphene Oxide", 26th International Conference on Micro Electro Mechanical Systems (MEMS), Jan. 20-24, 2013, pp. 709-712.
Zhou et al., "Electrostatic Graphene Loudspeaker", Applied Physics Letters, vol. 102, No. 22, 2013, pp. 1-15.
He et al., "Low Percolation Threshold of Graphene/Polymer Composites Prepared by Solvothermal Reduction of Graphene Oxide in the Polymer Solution", Nanoscale Research Letters, vol. 8, No. 132, Mar. 22, 2013, pp. 1-7.
Zhou et al., "Graphene Electrostatic Microphone and Ultrasonic Radio", PNAS, vol. 112, No. 29, Jul. 21, 2015, pp. 8942-8946.
Chang et al., "Piezoelectric Properties of Graphene Oxide From the First-Principles Calculations", Materials Science, Apr. 6, 2014, pp. 1-10.
"Piezo Speaker Technology, an Answer to Your Request", Sonitron, Retrieved on Apr. 23, 2018, Webpage available at : http://www.sonitron.be/site/nieuws.php?id=5.
Gaskell et al., "Graphene Oxide Based Materials as Acoustic Transducers: A Ribbon Microphone Application Case Study", 137th Audio Engineering Society Convention, Oct. 8, 2014, pp. 973-979.
Bae et al., "Graphene-P(VDF-TrFE) Multilayer Film for Flexible Applications", ACS Nano, vol. 7, No. 4, 2013, pp. 3130-3138.
Saber et al., "Superior Piezoelectric Composite Films: Taking Advantage of Carbon Nanomaterials", Nanotechnology, vol. 25, No. 4, Jan. 7, 2014, pp. 1-10.
"Korean Researchers Use Graphene to Create Transparent Loudspeakers", phys.org, Retrieved on Apr. 25, 2018, Webpage available at : https://phys.org/news/2011-07-korean-graphene-transparent-loudspeakers.html.
Chang et al., "Piezoelectric Properties of Graphene Oxide: A First-Principles Computational Study", Applied Physics Letters, vol. 105, No. 2, Jul. 2014, 5 pages.
Extended European Search Report received for corresponding European Patent Application No. 15193289.4, dated May 6, 2016, 9 pages.
International Search Report and Written Opinion received for corresponding Patent Cooperation Treaty Application No. PCT/FI2016/050702, dated Dec. 8, 2016, 12 pages.
Office action received for corresponding European Patent Application No. 15193289.4, dated Apr. 25, 2018, 6 pages.
Shin et al., "Flexible and Transparent Graphene Films as Acoustic Actuator Electrodes using Inkjet Printing", Chemical Communications, vol. 47, No. 30, Jun. 2011, pp. 8527-8529.
Office action received for corresponding European Patent Application No. 15193289.4, dated Nov. 21, 2018, 5 pages.

* cited by examiner

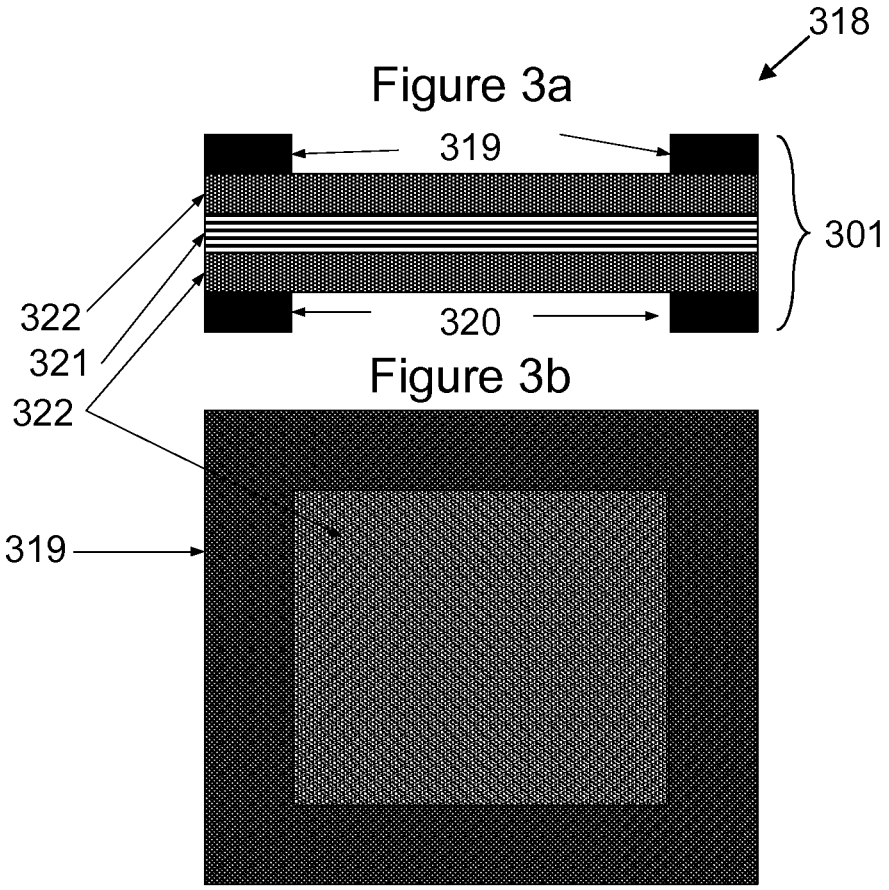
318
Figure 3a
319
301
322
321
320
Figure 3b
322
319
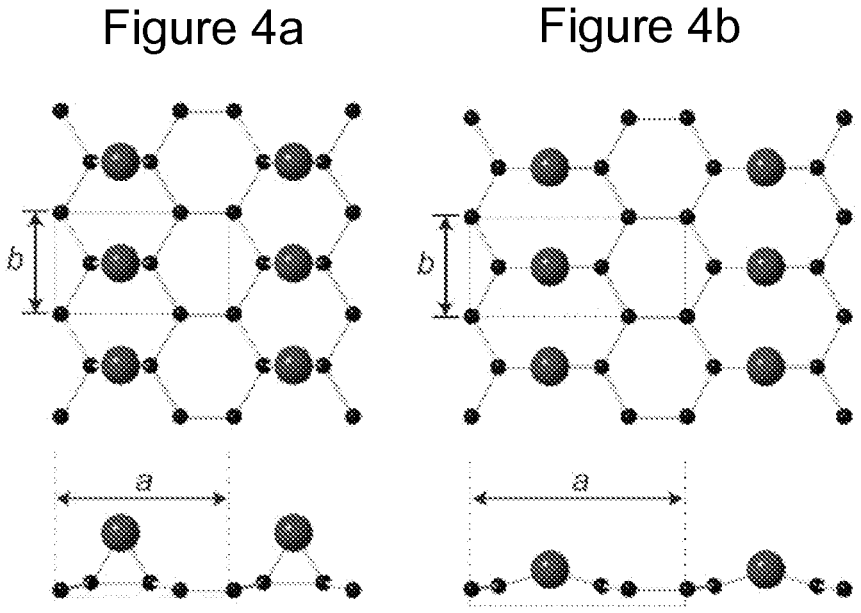
Figure 4a
Figure 4b
b
a
b
a

ACOUSTIC APPARATUS AND ASSOCIATED METHODS

RELATED APPLICATION

This application was originally filed as PCT Application No. PCT/FI2016/050702 filed Oct. 7, 2016 which claims priority benefit from EP Application No. 15193289.4 filed Nov. 5, 2015.

TECHNICAL FIELD

The present disclosure relates particularly to acoustic devices, associated methods and apparatus. Certain embodiments specifically concern an apparatus comprising a graphene oxide-based piezoelectric diaphragm configured to have one or more of a sound output mode and a sound input. Certain aspects/embodiments may relate to portable electronic devices, in particular, so-called hand-portable electronic devices which may be hand-held in use (although they may be placed in a cradle in use). Such hand-portable electronic devices include so-called Personal Digital Assistants (PDAs) and tablet PCs.

The portable electronic devices/apparatus according to one or more disclosed example aspects/embodiments may provide one or more audio/text/video communication functions (e.g. tele-communication, video-communication, and/or text transmission, Short Message Service (SMS)/Multimedia Message Service (MMS)/emailing functions, interactive/non-interactive viewing functions (e.g. web-browsing, navigation, TV/program viewing functions), music recording/playing functions (e.g. MP3 or other format and/or (FM/AM) radio broadcast recording/playing), downloading/sending of data functions, image capture function (e.g. using a (e.g. in-built) digital camera), and gaming functions.

BACKGROUND

Research is currently being done to develop new and improved acoustic devices.

The listing or discussion of a prior-published document or any background in this specification should not necessarily be taken as an acknowledgement that the document or background is part of the state of the art or is common general knowledge.

SUMMARY

According to a first aspect, there is provided an apparatus comprising a piezoelectric diaphragm positioned between opposing first and second electrodes, the piezoelectric diaphragm comprising a stack of graphene oxide layers between respective electrode-engaging layers of reduced graphene oxide, wherein the apparatus is configured to have one or more of a sound output mode and a sound input mode such that:

in the sound output mode, the first and second electrodes are configured to apply a voltage to the reduced graphene oxide layers to generate an electric field across the graphene oxide stack, the generated electric field causing vibration of the piezoelectric diaphragm to produce a sound output wave corresponding to the applied voltage, and in the sound input mode, the reduced graphene oxide layers are configured to collect electrical charge which is induced in the graphene oxide layers by vibration of the piezoelectric diaphragm in response to a sound input wave, the collected electrical charge creating a voltage between the first and second electrodes corresponding to the sound input wave.

The electrode-engaging layers of reduced graphene oxide may be formed from one or more outer layers of graphene oxide on opposing sides of the stack which have been reduced.

The graphene oxide stack may comprise up to 10, 20, 30, 40 or 50 layers of graphene oxide, and the electrode-engaging layers may be formed from the outermost 1-5 layers on opposing sides of the stack.

In certain embodiments, each of the layers of the stack may be formed from graphene oxide. In other embodiments, however, the graphene oxide stack may comprise one or more (intermediate) layers which are not graphene oxide. These layers may be configured to increase the piezoelectric effect or provide further properties (e.g. improved strength or resilience). For example, the additional layers of material may comprise corona-charged porous and non-porous polytetrafluoroethylene (PTFE), polypropylene (PP) and polyurethane (PU) films because of their light weight and piezoelectricity. This may help to reach higher frequencies and provide additional mechanical support, especially for piezoelectric diaphragms with larger surface areas/diameters. Furthermore, the graphene oxide stack may comprise two or more sub-stacks each comprising a plurality of graphene oxide layers (e.g. up to 10, 20, 30, 40 or 50 layers). The two or more sub-stacks may or may not be separated from one another by one or more intermediate non-graphene oxide layers.

The piezoelectric diaphragm may have a total thickness of less than or equal to 10 nm, 20 nm or 30 nm.

One or more of the graphene oxide layers may have a clamped or unzipped structural configuration.

The graphene oxide layers in the clamped configuration may have a carbon/oxygen ratio of 2:1 or 4:1, and the graphene oxide layers in the unzipped configuration may have a carbon/oxygen ratio of 4:1 or 8:1.

The apparatus may be configured such that, in the sound output mode, the generated electric field is substantially perpendicular to the layers of graphene oxide.

The apparatus may be configured such that, in the sound output mode, the generated electric field is perpendicular to the basal plane of the graphene oxide layers.

One or more of the sound input wave and the sound output wave may have a frequency of up to 20 kHz, 100 kHz, 1 MHz, 10 MHz, 100 MHz, 1 GHz and 10 GHz.

The apparatus may be one or more of an electronic device, a portable electronic device, a portable telecommunications device, a mobile phone, a personal digital assistant, a tablet, a phablet, a desktop computer, a laptop computer, a server, a smartphone, a smartwatch, smart eyewear, a wearable device, a loudspeaker, a microphone, an ultrasonic device, a sensor, a range finder, an identification tag, an identification tag reader, an imaging system, an acoustic microscope, a medical device, a sonicator, a transmitter, a receiver, and a module for one or more of the same.

According to a further aspect, there is provided a method of using an apparatus, the apparatus comprising a piezoelectric diaphragm positioned between opposing first and second electrodes, the piezoelectric diaphragm comprising a stack of graphene oxide layers between respective electrode-engaging layers of reduced graphene oxide, the method comprising one or more of:

applying a voltage, using the first and second electrodes, to the reduced graphene oxide layers to generate an electric field across the graphene oxide stack, the generated electric field causing vibration of the piezoelectric diaphragm to produce a sound output wave corresponding to the applied voltage to provide for a sound output mode; and collecting electrical charge, using the reduced graphene oxide layers, which is induced in the graphene oxide layers by vibration of the piezoelectric diaphragm in response to a sound input wave, the collected electrical charge creating a voltage between the first and second electrodes corresponding to the sound input wave to provide for a sound input mode.

According to a further aspect, there is provided a method of making an apparatus, the method comprising:

forming an electrode-engaging layer of reduced graphene oxide on opposing sides of a stack of graphene oxide layers to produce a piezoelectric diaphragm;

positioning the piezoelectric diaphragm between opposing first and second electrodes; and configuring the apparatus to have one or more of a sound output mode and a sound input mode such that:

in the sound output mode, the first and second electrodes are configured to apply a voltage to the reduced graphene oxide layers to generate an electric field across the graphene oxide stack, the generated electric field causing vibration of the piezoelectric diaphragm to produce a sound output wave corresponding to the applied voltage, and in the sound input mode, the reduced graphene oxide layers are configured to collect electrical charge which is induced in the graphene oxide layers by vibration of the piezoelectric diaphragm in response to a sound input wave, the collected electrical charge creating a voltage between the first and second electrodes corresponding to the sound input wave.

Forming the electrode-engaging layers of reduced graphene oxide may comprise reducing one or more outer layers of graphene oxide on opposing sides of the stack by at least one of chemical, thermal and electrochemical reduction.

The steps of any method disclosed herein do not have to be performed in the exact order disclosed, unless explicitly stated or understood by the skilled person.

Throughout the present specification, descriptors relating to relative orientation and position, such as "top", "bottom", "upper", "lower", "above" and "below", as well as any adjective and adverb derivatives thereof, are used in the sense of the orientation of the apparatus as presented in the drawings. However, such descriptors are not intended to be in any way limiting to an intended use of the described or claimed invention.

Corresponding computer programs for implementing one or more steps of the methods disclosed herein are also within the present disclosure and are encompassed by one or more of the described example embodiments.

One or more of the computer programs may, when run on a computer, cause the computer to configure any apparatus, including a circuit, controller, or device disclosed herein or perform any method disclosed herein. One or more of the computer programs may be software implementations, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software may be an assembly program.

One or more of the computer programs may be provided on a computer readable medium, which may be a physical computer readable medium such as a disc or a memory device, or may be embodied as a transient signal. Such a transient signal may be a network download, including an internet download.

The present disclosure includes one or more corresponding aspects, example embodiments or features in isolation or in various combinations whether or not specifically stated (including claimed) in that combination or in isolation. Corresponding means for performing one or more of the discussed functions are also within the present disclosure.

The above summary is intended to be merely exemplary and non-limiting.

BRIEF DESCRIPTION OF THE FIGURES

A description is now given, by way of example only, with reference to the accompanying drawings, in which:—

FIG. 3*a* shows one example of the present apparatus (cross-section);

FIG. 3*b* shows the apparatus of FIG. 3*a* in plan view;

FIG. 4*a* shows graphene oxide with a clamped structural configuration (schematic);

FIG. 4*b* shows graphene oxide with an unzipped structural configuration (schematic);

DESCRIPTION OF SPECIFIC ASPECTS/EMBODIMENTS

A loudspeaker is an electroacoustic transducer that converts an electrical signal into sound. The speaker vibrates in accordance with variations in the electrical signal, causing the air particles around it to move. When the speaker moves forwards and backwards, the air pressure increases and decreases accordingly. In this way, the speaker sends a wave of pressure fluctuation through the air as a travelling disturbance. When the fluctuation reaches our ears it causes the eardrum to vibrate back and forth, a motion which our brains interpret as sound.

We hear different sounds from different vibrating objects because of variations in sound wave frequency and air pressure level. A higher frequency simply means that the air pressure is fluctuating faster. We register this as a higher pitch. Air pressure level is the amplitude of the sound wave, which determines how loud the sound is. Sound waves with greater amplitudes move our ear drums more, and we register this sensation as a higher volume.

Loudspeakers are the most variable elements in a modern audio system and are usually responsible for most distortion and audible differences when comparing sound systems.

Figure 1A:
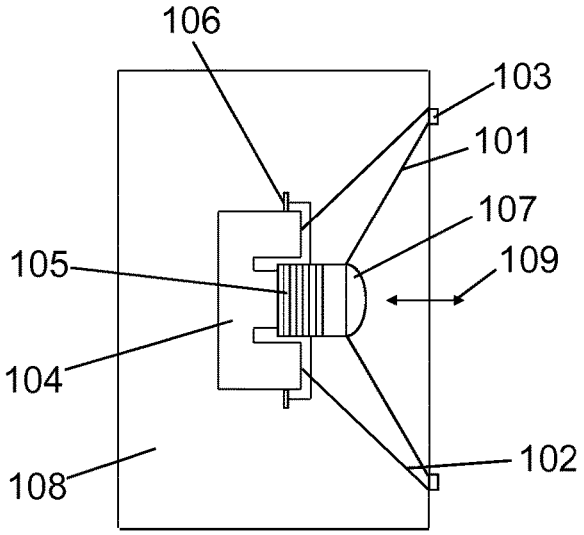
FIG. 1*a* shows a conventional loudspeaker (cross-section)

FIG. 1*a* shows a conventional loudspeaker. The speaker comprises a diaphragm 101, a frame 102, a suspension 103, a magnet 104, a voice coil 105, an audio signal input 106, a dust cap 107, and an enclosure 108. The speaker produces sound waves by rapidly vibrating the diaphragm 101. The diaphragm 101 is flexible (usually made of paper, plastic or metal) and is attached at its wide end to the suspension 103. The suspension 103 is a rim of flexible material that allows the diaphragm 101 to move, and is attached to the frame 102 of the speaker. The narrow end of the diaphragm 101 is connected to the voice coil 105, which itself is attached to the frame 102 by a ring of flexible material called a spider (not shown). The spider holds the voice coil 105 in position, but allows it to move back and forth freely. The dust cap 107 simply prevents dust particles from reaching the components of the loudspeaker.

The voice coil 105 is positioned in the constant magnetic field of the magnet 104. When a current flows though the voice coil 105, a force acts upon the voice coil, the direction of which depends upon the direction of the current in accordance with Fleming's left hand rule. In this way, an alternating current in the voice coil 105 can be used to reverse the force between the voice coil 105 and the magnet 104 repeatedly. This pushes the voice coil 105 back and forth rapidly like a piston.

When the coil 105 moves, it pushes and pulls on the diaphragm 101 (as indicated by the arrows 109). This causes vibration of the air in front of (and behind) the speaker, creating sound waves. The electrical audio signal can also be interpreted as a wave. The frequency and amplitude of this wave, which represents the recorded sound wave, dictates the rate and distance that the voice coil 105 moves. This in turn determines the frequency and amplitude of the sound waves produced by the diaphragm 101.

Different sizes of speaker are better suited for different frequency ranges. For this reason, loudspeaker units typically divide a wide frequency range between multiple speakers. The largest speakers are called "woofers", and are designed to produce low frequency sounds. "Tweeters" are much smaller units designed to produce the highest frequencies. Midrange speakers produce a range of frequencies in the middle of the sound spectrum. To faithfully reproduce the recorded sound, the audio signal needs to be broken up into the different frequency ranges that are handled by each type of speaker. This is performed by the speaker crossover circuit.

As shown in FIG. 1*a*, conventional loudspeakers are often housed in an enclosure 108. A loudspeaker enclosure 108 is a purpose-built cabinet in which the speakers (drivers) and associated electronic hardware (such as the crossover circuit and amplifiers) are mounted. Enclosures 108 may vary in design, from simple wooden boxes, to complex cabinets that incorporate specialised materials, internal baffles, ports, and acoustic insulation.

The primary role of the enclosure 108 is to prevent sound waves generated by the rear-facing surface of the diaphragm 101 from interacting with sound waves generated by the front-facing surface of the diaphragm 101. Since the forward and rearward generated sounds are out of phase with one another, any interaction between the two results in cancellation of the acoustic output at low frequencies, producing an approximately 6 dB roll-off per octave below a cut-off frequency at which the path-length between the rear and front of the diaphragm is approximately one-quarter wavelength. The enclosure 108 also plays a role in managing vibration induced by the speaker frame 102 and moving air mass within the enclosure 108, as well as heat generated by the voice coil 105 and amplifiers.

Figure 1B:
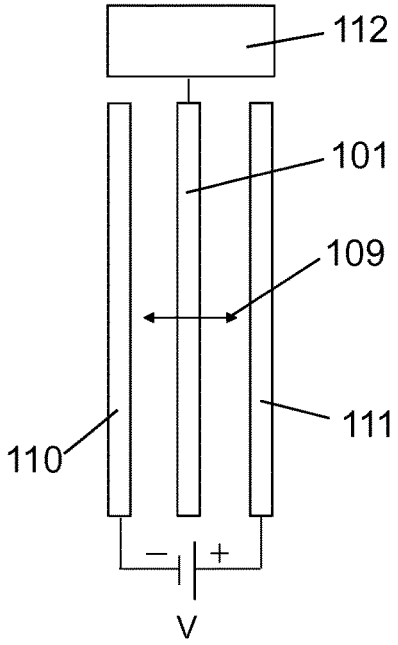
FIG. 1*b* shows an electrostatic loudspeaker (cross-section)

FIG. 1*b* shows another type of speaker known as an electrostatic loudspeaker. Electrostatic loudspeakers vibrate air with a large, thin, conductive diaphragm 101. The diaphragm 101 is suspended between two stationary conductive panels 110, 111 that are statically charged with opposite polarities. The panels 110, 111 create an electric field between them. The audio signal 112 causes a current to flow through the diaphragm 101 in alternating directions, rapidly switching the polarity of the diaphragm 101. When the diaphragm 101 is positively charged, it is drawn (as indicated by the arrows 109) towards the negative panel 110. When the diaphragm 101 is negatively charged, it is drawn towards the positive panel 111. In this way, the diaphragm 101 rapidly vibrates the air adjacent to it. Instead of applying the audio signal 112 to the diaphragm 101, some electrostatic speakers apply the audio signal 112 to the stationary panels 110, 111 and keep the polarity of the diaphragm 101 constant.

Since the diaphragm 101 has such a low mass, it responds very quickly and precisely to changes in the audio signal 112. This makes for clear and accurate sound reproduction. The diaphragm 101 does not move a great distance, however. As a result, it is relatively ineffective at producing lower frequency sounds, although increasing the diaphragm area can compensate for this. For this reason, electrostatic speakers are usually paired with a woofer to boost the low frequency range.

Figure 1C:
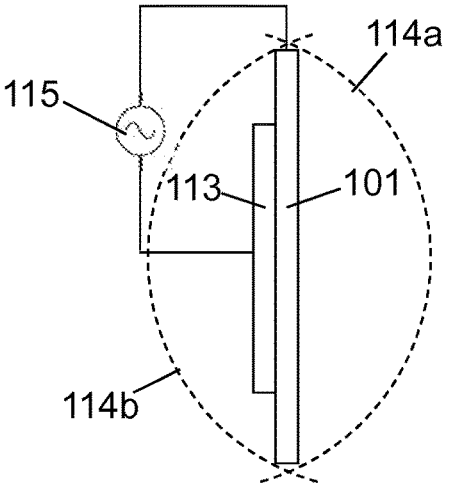
FIG. 1*c* shows a piezoelectric loudspeaker (cross-section)

FIG. 1*c* shows a further type of speaker called a piezoelectric loudspeaker. As the name suggests, piezoelectric loudspeakers use the (reverse) piezoelectric effect to generate sound. In the example shown in this figure, the speaker comprises a layer of piezoelectric material 113 attached to a mechanical diaphragm 101 (typically made of metal). When a voltage is applied to the piezoelectric material 113, the resulting electric field creates strain in the material 113 causing the attached diaphragm 101 to bend 114*a*.

If the voltage is then reversed, the diaphragm 101 is bent 114*b* in the opposite direction. In this way, an alternating voltage 115 can be used to cause vibration of the diaphragm 101 to produce an audible sound wave.

Piezoelectric speakers are simpler in construction that their conventional and electrostatic counterparts, and are therefore relatively cheap and easy to manufacture. They are also less prone to mechanical failure due to the smaller number of components. Nevertheless, existing piezoelectric speakers tend to have a poorer frequency response (at least in comparison to conventional loudspeakers) and are therefore generally limited to less-critical high frequency applications, such as tweeters, watches and buzzers.

Figure 2:
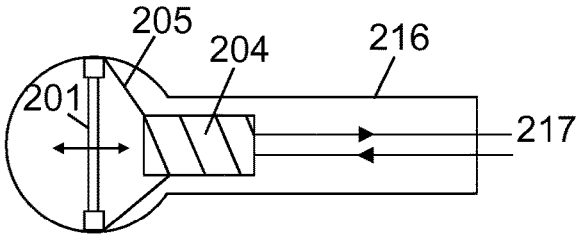
FIG. 2 shows a conventional microphone (cross-section)

FIG. 2 illustrates schematically a conventional microphone. Microphones are structurally similar to loudspeakers, but they operate in reverse. As shown in FIG. 2, a conventional microphone comprises a diaphragm 201, a coil 205 and a permanent magnet 204 contained within an acoustically transparent casing 216. The coil 205 is wound around the permanent magnet 204 and is attached to the diaphragm 201. Incoming sound waves are carried by vibrations in the air through the casing 216 to the diaphragm 201 causing the diaphragm 201 to vibrate. Since the coil 205 is attached to the diaphragm 201, it moves back and forth through the magnetic field of the permanent magnet 204 generating an electrical current 217 in the coil 205 via Faraday's law. The electrical current 217 then flows from the microphone casing 216 to an amplifier or recording device (not shown). The incoming sound wave is therefore converted into a corresponding electrical signal 217. Like loudspeakers, many different types of microphone currently exist (including electrostatic and piezoelectric microphones).

As portable electronic devices get smaller and/or thinner, the size of the functional components is forced to decrease. In addition, there is currently a demand for larger displays which enable a greater amount of information to be viewed at a given time. The combination of smaller/thinner devices and larger displays puts pressure on device manufacturers to reduce the size of loudspeakers and microphones. Unfortunately, little further size reduction can be achieved with existing loudspeakers and microphones without sacrificing audio performance. At the moment, the performance is adequate for speech, but expectations are continually increasing for music output. With current mobile phones, the sound is often routed through the back or sides of the housing due to a lack of space on the front of the device, thereby compromising the audio output further.

There will now be described an apparatus and associated methods that may address this issue.

FIG. 3 shows one example of the present apparatus 318. The apparatus 318 comprises a piezoelectric diaphragm 301 positioned between opposing first 319 and second 320 electrodes, and is configured to operate in one or more of a sound output mode (e.g. as a loudspeaker) and a sound input mode (e.g. as a microphone). The piezoelectric diaphragm 301 comprises a stack of graphene oxide layers 321 between respective electrode-engaging layers 322 of reduced graphene oxide (sometimes referred to as graphene). The first 319 and second 320 electrodes may be formed from a metal (e.g. gold, silver or copper), alloy (e.g. silver nickel or silver copper nickel) or conductive ceramic (e.g. indium tin oxide, silver tin oxide or silver cadmium oxide).

In the sound output mode, the first 319 and second 320 electrodes are configured to apply a voltage to the reduced graphene oxide layers 322 to generate an electric field across the graphene oxide stack 321. The generated electric field causes vibration of the piezoelectric diaphragm 301 to produce a sound output wave corresponding to the applied voltage. In the sound input mode, on the other hand, the reduced graphene oxide layers 322 are configured to collect electrical charge which is induced in the graphene oxide layers 321 by vibration of the piezoelectric diaphragm 301 in response to a sound input wave. The collected electrical charge creates a voltage between the first 319 and second 320 electrodes corresponding to the sound input wave. In some examples, the present apparatus 318 may be reconfigurable between the sound output and sound input modes (e.g. on user selection with appropriate circuit elements and/or software associated with the apparatus).

The present apparatus 318 takes advantage of the piezoelectric nature of graphene oxide 321. Graphene oxide 321 is a two-dimensional material which is stronger and lighter than the ceramic materials used in current piezoelectric loudspeakers. This provides for a more compact structure which is suitable for use in smaller/thinner electronic devices. The strength and weight of graphene oxide 321 also enables the transduction of a broader range of frequencies than existing loudspeakers and microphones.

Furthermore, the electrode-engaging layers 322 of reduced graphene oxide enable the generation of a substantially uniform electric field across the graphene oxide stack 321 in the sound output mode, and the collection of electrical charge from different points on the upper and lower surfaces of the graphene oxide stack 321 in the sound input mode. These aspects provide for more efficient audio output/input.

The electrode-engaging layers 322 of reduced graphene oxide may advantageously be formed from one or more outer layers of graphene oxide 321 on opposing sides of the stack which have been reduced. For example, the graphene oxide stack 321 may comprise up to 10, 20, 30, 40 or 50 layers of graphene oxide (with or without one or more non-graphene oxide layers), and the electrode-engaging layers 322 may be formed from the outermost 1-5 layers on opposing sides of the stack 322. This allows the piezoelectric diaphragm 301 to be formed as a monolithic stack which facilitates fabrication of the apparatus 318. Furthermore, the resulting piezoelectric diaphragm 301 would typically have a total thickness of no more than 30 nm (possibly less than or equal to 10 or 20 nm, depending on the number of layers in the stack 321).

Reduction of the graphene oxide 321 may be achieved using one or more of chemical, thermal and electrochemical reduction. Suitable techniques involve: treating the graphene oxide 321 with hydrazine hydrate and maintaining the solution at 100° C. for 24 hours; exposing the graphene oxide 321 to hydrogen plasma for a few seconds; exposing the graphene oxide 321 to pulsed light from a xenon flashtube; heating the graphene oxide 321 in distilled water (at various temperatures and times); combining the graphene oxide 321 with an expansion-reduction agent such as urea and heating the solution to release reducing gases; directly heating the graphene oxide 321 to temperatures of over 1000° C. in a furnace; and linear sweep voltammetry.

Linear sweep voltammetry in particular has been found to produce high quality reduced graphene oxide 322 almost identical in structure to pristine graphene. This process involves passing a current through the plane of the graphene oxide layer(s) 321 at various voltages in a sodium phosphate buffer. The resulting electrochemically reduced graphene oxide 322 has shown a very high carbon/oxygen ratio and electronic conductivity readings higher than silver.

The piezoelectric effect only exists in crystalline materials with no inversion symmetry. Recent studies have shown that the doping of oxygen atoms on the hexagonal lattice of pristine graphene can form two highly ordered structural configurations of graphene oxide: the so-called "clamped" and "unzipped" configurations. For both of these configurations, there are several different stoichiometries in terms of the carbon/oxygen ratio, each of which breaks the inversion symmetry of pristine graphene to induce piezoelectricity.

FIGS. 4*a* and 4*b* respectively illustrate the unit cells of the clamped and unzipped configurations with a carbon/oxygen ratio of 4:1 (Z. Chang et al, Appl. Phys. Lett., 105, 023103 (2014)). The carbon and oxygen atoms are represented by the smaller and larger spheres, respectively, and the unit cells are depicted by dotted lines with in-plane lattice parameters shown as "a" and "b". The key difference between the two structures is that the C—C bond below the oxygen atom in the clamped configuration is broken in the unzipped configuration.

It has been found that the greatest in-plane strain and strain piezoelectric coefficient d31 (i.e. strain vs electric field) occur when the electric field is applied perpendicular to the basal plane of the graphene oxide (i.e. the plane perpendicular to the principal axis of symmetry). The clamped graphene oxide has demonstrated a greater strain and d31 coefficient than its unzipped counterpart. Furthermore, the strain and d31 coefficient have been found to increase with increasing oxygen content for the clamped configuration but decrease for the unzipped configuration. For example, a greater piezoelectric effect has been observed with clamped $C_2O$ compared with clamped $C_4O$, and with unzipped $C_8O$ compared with unzipped $C_4O$. In addition, clamped graphene oxide with a carbon/oxygen ratio of >4, and unzipped graphene oxide with a carbon/oxygen ratio of <4, have been found to be chemically unstable.

The highest values of in-plane strain and d31 coefficient (0.12% and 0.24 pm/V, respectively) were obtained for clamped $C_2O$, which are comparable with engineered piezoelectric graphene and some three-dimensional piezoelectric materials. Although certain ceramic materials (such as lead zirconate titanate, PZT) exhibit a greater piezoelectric response, they cannot be used at thicknesses of less than 10 nm otherwise the depolarization field generated by the accumulated charges completely suppresses the piezoelectric effects. This does not occur with graphene oxide. Hence, the present apparatus is more suitable for use in smaller/thinner devices than these ceramics.

In view of the above, the present apparatus may comprise graphene oxide having a clamped configuration with a carbon/oxygen ratio of 2:1 or 4:1, or an unzipped configuration with a carbon/oxygen ratio of 4:1 or 8:1. In addition, the apparatus may be configured such that, in the sound output mode, the generated electric field is substantially perpendicular to the layers of graphene oxide (and in some cases, substantially perpendicular to the basal plane of the graphene oxide layers).

As mentioned above, current audio equipment is often limited to a relatively narrow frequency range. As a result, several loudspeakers of differing size are normally required just to cover the audible 20 Hz-20 kHz acoustic band. Furthermore, many loudspeakers and microphones are incapable of handling ultrasonic frequencies. The present apparatus may provide a solution. The low mass and low spring constant of the graphene-based diaphragm, in combination with high air damping, provides a high-fidelity broadband frequency response with greater power efficiency. Depending on the specific dimensions of the graphene oxide stack, the present apparatus may be able to handle sound input waves (e.g. as a microphone) and sound output waves (e.g. as a loudspeaker) with frequencies of up to 20 kHz, 100 kHz, 1 MHz, 10 MHz, 100 MHz, 1 GHz and 10 GHz. This wide frequency range means that the present apparatus is not limited to loudspeaker and microphone applications, however. For example, the apparatus may form part of an ultrasonic device, such as a sensor (e.g. motion sensor or flow meter), a range finder (e.g. sonar), an identification tag/reader (e.g. ultrasonic identification, USID), an imaging system (e.g. industrial non-destructive testing or quality control), an acoustic microscope, a medical device (e.g. for sonography or physical therapy), a sonicator (e.g. ultrasonic cleaner or disintegrator), or a transmitter/receiver (e.g. for underwater communications).

Figure 5:
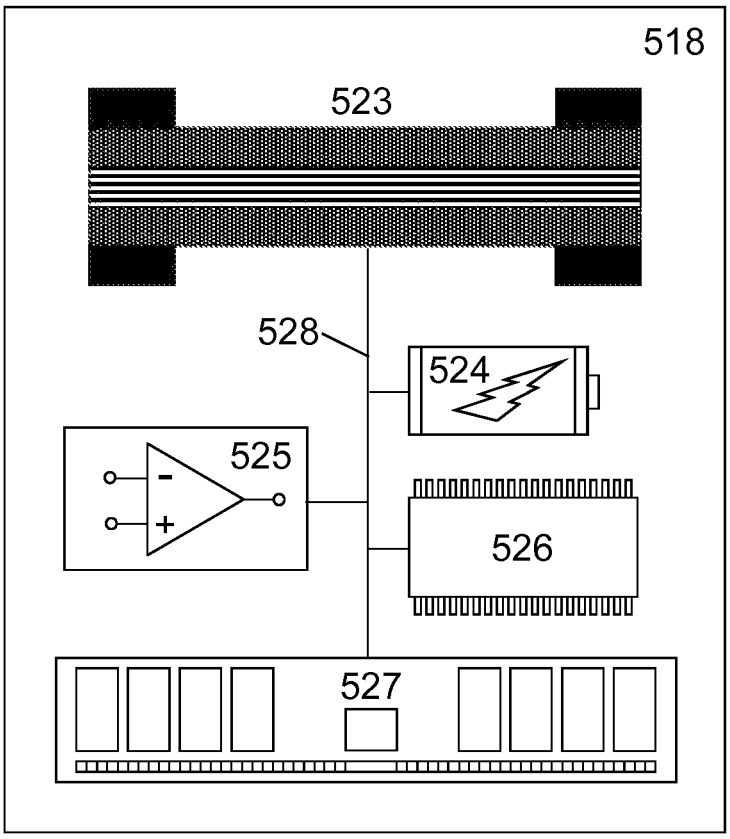
FIG. 5 shows another example of the present apparatus (schematic)

FIG. 5 shows another example of the present apparatus 518. The apparatus 518 may be one or more of an electronic device, a portable electronic device, a portable telecommunications device, a mobile phone, a personal digital assistant, a tablet, a phablet, a desktop computer, a laptop computer, a server, a smartphone, a smartwatch, smart eyewear, a wearable device, a (piezoelectric) loudspeaker, a (piezoelectric) microphone, an above-mentioned ultrasonic device, and a module for one or more of the same. In the example shown, the apparatus 518 comprises the various components described previously (denoted collectively by reference numeral 523), a power source 524, an amplifier 525, a processor 526 and a storage medium 527, which are electrically connected to one another by a data bus 528.

The processor 526 is configured for general operation of the apparatus 518 by providing signalling to, and receiving signalling from, the other components to manage their operation. The storage medium 527 is configured to store computer code configured to perform, control or enable operation of the apparatus 518. The storage medium 527 may also be configured to store settings for the other components. The processor 526 may access the storage medium 527 to retrieve the component settings in order to manage the operation of the other components.

In the sound output mode, the power source 524 (under the control of the processor 526) is configured to apply a voltage to the reduced graphene oxide layers via the first and second electrodes to generate an electric field across the graphene oxide stack. The voltage applied to the reduced graphene oxide layers is driven by an electrical audio signal, which may have been amplified by the amplifier 525 prior to transduction. The electrical audio signal may be stored in the storage medium 527 (e.g. as a music file), or it may be received from a remote device (e.g. incoming voice signal as part of a telephone call) or a microphone (e.g. in a public address system). The apparatus 518 may further comprise an antenna for communicating with the remote device and/or a microphone for direct audio input (not shown). In some cases, the piezoelectric diaphragm and electrodes used for sound output may also be used for sound input (thus avoiding the need for a separate microphone). In this scenario, the apparatus may also comprise appropriate circuit elements and software (not shown) to allow for switching between the sound output and sound input modes (e.g. based on user selection). The generated electric field causes vibration of the piezoelectric diaphragm to produce a sound output wave corresponding to the applied voltage/electrical audio signal.

In the sound input mode, the reduced graphene oxide layers are configured to collect electrical charge which is induced in the graphene oxide layers by vibration of the piezoelectric diaphragm in response to a sound input wave. The collected electrical charge creates a voltage between the first and second electrodes corresponding to the sound input wave, which may be amplified by the amplifier 525. The voltage forms an electrical audio signal which can be stored in the storage medium 527 (e.g. voice recordal), transmitted to a remote device (e.g. outgoing voice signal as part of a telephone call) or passed to a loudspeaker (e.g. in a public address system). The apparatus 518 may further comprise an antenna for communicating with the remote device and/or a loudspeaker for direct audio output (not shown). In some cases, the piezoelectric diaphragm and electrodes used for sound input may also be used for sound output (thus avoiding the need for a separate loudspeaker). In this scenario, the apparatus may also comprise appropriate circuit elements and software (not shown) to allow for switching between the sound input and sound output modes (e.g. based on user selection).

The processor 526 may be a microprocessor, including an Application Specific Integrated Circuit (ASIC). The storage medium 527 may be a temporary storage medium such as a volatile random access memory. On the other hand, the storage medium 527 may be a permanent storage medium 527 such as a hard disk drive, a flash memory, or a non-volatile random access memory. The power source 524 may comprise one or more of a primary battery, a secondary battery, a capacitor, a supercapacitor and a battery-capacitor hybrid.

Figure 6A:
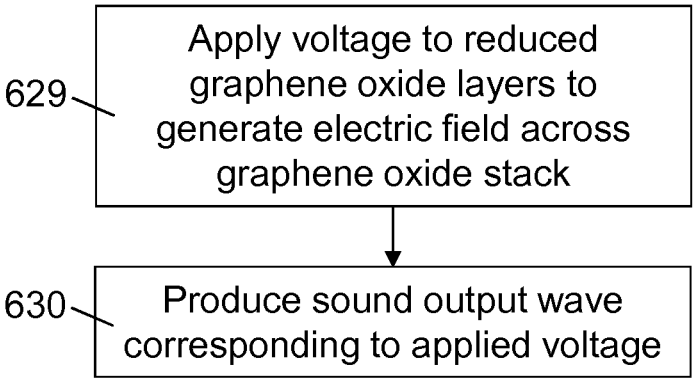
FIG. 6*a* shows a method of using the present apparatus (flow chart)

FIG. 6*a* shows schematically the main steps 629-630 of a method of using the present apparatus in the sound output mode. The method generally comprises: applying a voltage, using the first and second electrodes, to the reduced graphene oxide layers to generate an electric field across the graphene oxide stack 629; and producing a sound output wave corresponding to the applied voltage using the vibration of the piezoelectric diaphragm caused by the generated electric field 630.

Figure 6B:
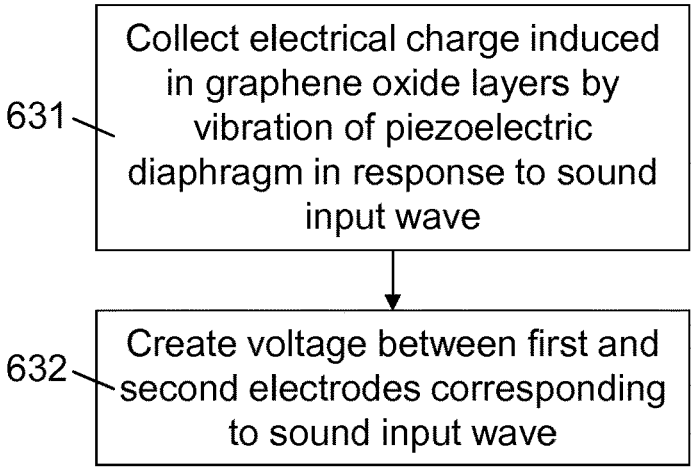
FIG. 6*b* shows another method of using the present apparatus (flow chart)

FIG. 6*b* shows schematically the main steps 631-632 of a method of using the present apparatus in the sound input mode. The method generally comprises: collecting electrical charge, using the reduced graphene oxide layers, which is induced in the graphene oxide layers by vibration of the piezoelectric diaphragm in response to a sound input wave 631; and creating a voltage between the first and second electrodes corresponding to the sound input wave using the collected electrical charge 632.

Figure 6C:
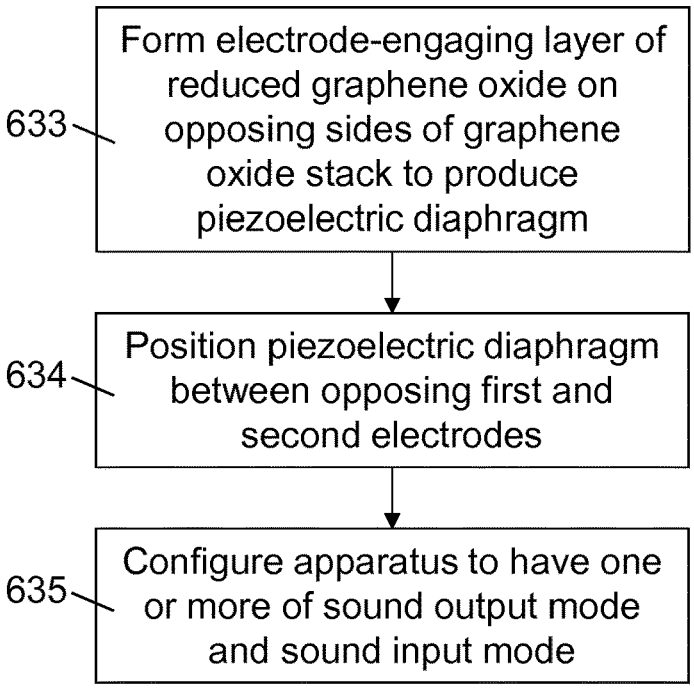
FIG. 6*c* shows a method of making the present apparatus (flow chart)

FIG. 6*c* shows schematically the main steps 633-635 of a method of making the present apparatus. The method generally comprises: forming an electrode-engaging layer of reduced graphene oxide on opposing sides of a stack of graphene oxide layers to produce a piezoelectric diaphragm 633; positioning the piezoelectric diaphragm between opposing first and second electrodes 634; and configuring the apparatus to have one or more of a sound output mode and a sound input mode 635.

Figure 7:
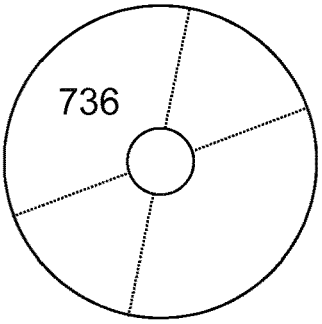
FIG. 7 shows a computer-readable medium comprising a computer program configured to perform, control or enable a method described herein (schematic).

FIG. 7 illustrates schematically a computer/processor readable medium 736 providing a computer program according to one embodiment. The computer program may comprise computer code configured to perform, control or enable one or more of the method steps 629-635 of FIGS. 6*a*-6*c*. In this example, the computer/processor readable medium 736 is a disc such as a digital versatile disc (DVD) or a compact disc (CD). In other embodiments, the computer/processor readable medium 736 may be any medium that has been programmed in such a way as to carry out an inventive function. The computer/processor readable medium 736 may be a removable memory device such as a memory stick or memory card (SD, mini SD, micro SD or nano SD).

Other embodiments depicted in the figures have been provided with reference numerals that correspond to similar features of earlier described embodiments. For example, feature number 1 can also correspond to numbers 101, 201, 301 etc. These numbered features may appear in the figures but may not have been directly referred to within the description of these particular embodiments. These have still been provided in the figures to aid understanding of the further embodiments, particularly in relation to the features of similar earlier described embodiments.

It will be appreciated to the skilled reader that any mentioned apparatus/device and/or other features of particular mentioned apparatus/device may be provided by apparatus arranged such that they become configured to carry out the desired operations only when enabled, e.g. switched on, or the like. In such cases, they may not necessarily have the appropriate software loaded into the active memory in the non-enabled (e.g. switched off state) and only load the appropriate software in the enabled (e.g. on state). The apparatus may comprise hardware circuitry and/or firmware. The apparatus may comprise software loaded onto memory. Such software/computer programs may be recorded on the same memory/processor/functional units and/or on one or more memories/processors/functional units.

In some embodiments, a particular mentioned apparatus/device may be pre-programmed with the appropriate software to carry out desired operations, and wherein the appropriate software can be enabled for use by a user downloading a "key", for example, to unlock/enable the software and its associated functionality. Advantages associated with such embodiments can include a reduced requirement to download data when further functionality is required for a device, and this can be useful in examples where a device is perceived to have sufficient capacity to store such pre-programmed software for functionality that may not be enabled by a user.

It will be appreciated that any mentioned apparatus/circuitry/elements/processor may have other functions in addition to the mentioned functions, and that these functions may be performed by the same apparatus/circuitry/elements/processor. One or more disclosed aspects may encompass the electronic distribution of associated computer programs and computer programs (which may be source/transport encoded) recorded on an appropriate carrier (e.g. memory, signal).

It will be appreciated that any "computer" described herein can comprise a collection of one or more individual processors/processing elements that may or may not be located on the same circuit board, or the same region/position of a circuit board or even the same device. In some embodiments one or more of any mentioned processors may be distributed over a plurality of devices. The same or different processor/processing elements may perform one or more functions described herein.

It will be appreciated that the term "signalling" may refer to one or more signals transmitted as a series of transmitted and/or received signals. The series of signals may comprise one, two, three, four or even more individual signal components or distinct signals to make up said signalling. Some or all of these individual signals may be transmitted/received simultaneously, in sequence, and/or such that they temporally overlap one another.

With reference to any discussion of any mentioned computer and/or processor and memory (e.g. including ROM, CD-ROM etc), these may comprise a computer processor, Application Specific Integrated Circuit (ASIC), field-programmable gate array (FPGA), and/or other hardware components that have been programmed in such a way to carry out the inventive function.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

While there have been shown and described and pointed out fundamental novel features as applied to different embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. An apparatus comprising a piezoelectric diaphragm positioned between first and second electrodes, the piezoelectric diaphragm comprising a stack of graphene oxide layers between respective electrode-engaging layers of reduced graphene oxide, wherein the apparatus is configured to have a sound output mode, or a sound input mode such that:

in a sound output mode, the first and second electrodes are configured to apply a voltage to the reduced graphene oxide layers to generate an electric field across the graphene oxide stack, the generated electric field causing vibration of the piezoelectric diaphragm to produce a sound output wave corresponding to the applied voltage, and in a sound input mode, the reduced graphene oxide layers are configured to collect electrical charge which is induced in the graphene oxide layers by vibration of the piezoelectric diaphragm in response to a sound input wave, the collected electrical charge creating a voltage between the first and second electrodes corresponding to the sound input wave.

2. The apparatus of claim 1, wherein the electrode-engaging layers of reduced graphene oxide are formed from one or more outer layers of graphene oxide on opposing sides of the stack which have been reduced.

3. The apparatus of claim 2, wherein the graphene oxide stack comprises up to 10, 20, 30, 40 or 50 layers of graphene oxide, and the electrode-engaging layers are formed from the outermost 1-5 layers on opposing sides of the stack.

4. The apparatus of claim 1, wherein the piezoelectric diaphragm has a total thickness of less than or equal to 10 nm, 20 nm or 30 nm.

5. The apparatus of claim 1, wherein one or more of the graphene oxide layers have a clamped or unzipped structural configuration.

6. The apparatus of claim 5, wherein the graphene oxide layers in the clamped configuration have a carbon/oxygen ratio of 2:1 or 4:1, and the graphene oxide layers in the unzipped configuration have a carbon/oxygen ratio of 4:1 or 8:1.

7. The apparatus of claim 1, wherein the apparatus is configured such that, in the sound output mode, the generated electric field is substantially perpendicular to the layers of graphene oxide.

8. The apparatus of claim 1, wherein the apparatus is configured such that, in the sound output mode, the generated electric field is perpendicular to a basal plane of the graphene oxide layers.

9. The apparatus of claim 1, wherein one or more of the sound input wave and the sound output wave have a frequency of up to 20 kHz, 100 kHz, 1 MHz, 10 MHz, 100 MHz, 1 GHz and 10 GHz.

10. The apparatus of claim 1, wherein the apparatus is one or more of an electronic device, a portable electronic device, a portable telecommunications device, a mobile phone, a personal digital assistant, a tablet, a phablet, a desktop computer, a laptop computer, a server, a smartphone, a smartwatch, smart eyewear, a wearable device, a loudspeaker, a microphone, an ultrasonic device, a sensor, a range finder, an identification tag, an identification tag reader, an imaging system, an acoustic microscope, a medical device, a sonicator, a transmitter, a receiver, and a module for one or more of the same.

11. A method of using an apparatus, the apparatus comprising a piezoelectric diaphragm positioned between opposing first and second electrodes, the piezoelectric diaphragm comprising a stack of graphene oxide layers between respective electrode-engaging layers of reduced graphene oxide, the method comprising one or more of:

applying a voltage, using the first and second electrodes, to the reduced graphene oxide layers to generate an electric field across the graphene oxide stack, the generated electric field causing vibration of the piezoelectric diaphragm to produce a sound output wave corresponding to the applied voltage to provide for a sound output mode; and collecting electrical charge, using the reduced graphene oxide layers, which is induced in the graphene oxide layers by vibration of the piezoelectric diaphragm in response to a sound input wave, the collected electrical charge creating a voltage between the first and second electrodes corresponding to the sound input wave to provide for a sound input mode.

12. The method of claim 11, wherein the electrode-engaging layers of reduced graphene oxide are formed from one or more outer layers of graphene oxide on opposing sides of the stack which have been reduced.

13. The method of claim 12, wherein the graphene oxide stack comprises up to 10, 20, 30, 40 or 50 layers of graphene oxide, and the electrode-engaging layers are formed from the outermost 1-5 layers on opposing sides of the stack.

14. The method of claim 11, wherein the piezoelectric diaphragm has a total thickness of less than or equal to 10 nm, 20 nm or 30 nm.

15. The method of claim 11, wherein one or more of the graphene oxide layers have a clamped or unzipped structural configuration.

16. The method of claim 15, wherein the graphene oxide layers in the clamped configuration have a carbon/oxygen ratio of 2:1 or 4:1, and the graphene oxide layers in the unzipped configuration have a carbon/oxygen ratio of 4:1 or 8:1.

17. The method of claim 11, wherein the apparatus is configured such that, in the sound output mode, the generated electric field is substantially perpendicular to the layers of graphene oxide.

18. A method of making an apparatus, the method comprising:

forming an electrode-engaging layer of reduced graphene oxide on opposing sides of a stack of graphene oxide layers to produce a piezoelectric diaphragm;

positioning the piezoelectric diaphragm between opposing first and second electrodes; and configuring the apparatus to have one or more of a sound output mode and a sound input mode such that:

in the sound output mode, the first and second electrodes are configured to apply a voltage to the reduced graphene oxide layers to generate an electric field across the graphene oxide stack, the generated electric field causing vibration of the piezoelectric diaphragm to produce a sound output wave corresponding to the applied voltage, and in the sound input mode, the reduced graphene oxide layers are configured to collect electrical charge which is induced in the graphene oxide layers by vibration of the piezoelectric diaphragm in response to a sound input wave, the collected electrical charge creating a voltage between the first and second electrodes corresponding to the sound input wave.

19. The method of claim 18, wherein forming the electrode-engaging layers of reduced graphene oxide comprises reducing one or more outer layers of graphene oxide on opposing sides of the stack by at least one of chemical, thermal and electrochemical reduction.

* * * * *